US006572354B2

(12) United States Patent
Kammhoff et al.

(10) Patent No.: US 6,572,354 B2
(45) Date of Patent: Jun. 3, 2003

(54) SCREW COMPRESSOR HAVING A SHAFT SEAL NEAR A BEARING

(75) Inventors: Karl-Fr. Kammhoff, Weil der Stadt (DE); Christian Scharer, Gaggenau (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 10/122,130

(22) Filed: Apr. 12, 2002

(65) Prior Publication Data

US 2002/0159907 A1 Oct. 31, 2002

Related U.S. Application Data

(63) Continuation of application No. PCT/EP01/08597, filed on Jul. 25, 2001.

(30) Foreign Application Priority Data

Aug. 16, 2000 (DE) ..... 100 40 020

(51) Int. Cl.[7] ..... F04C 18/16; F04C 27/00
(52) U.S. Cl. ..... 418/104; 418/201.1
(58) Field of Search ..... 418/104, 201.1

(56) References Cited

U.S. PATENT DOCUMENTS

| | | | | |
|---|---|---|---|---|
| 4,487,563 A | | 12/1984 | Mori et al. | 418/104 |
| 4,984,974 A | * | 1/1991 | Naya et al. | 418/104 |
| 5,009,583 A | | 4/1991 | Carlsson et al. | 418/104 |
| 5,281,116 A | * | 1/1994 | Gwin | 418/201.1 |
| 5,314,320 A | * | 5/1994 | Shimizu et al. | 418/201.1 |
| 6,364,645 B1 | | 4/2002 | Dieterich | 418/201.1 |

FOREIGN PATENT DOCUMENTS

| | | |
|---|---|---|
| DE | 33 26 910 | 3/1984 |
| DE | 196 26 515 | 1/1998 |
| DE | 198 45 993 | 4/2000 |
| EP | 0 859 154 | 8/1998 |
| WO | 00/42322 | 7/2000 |

OTHER PUBLICATIONS

*Patent Abstract of Japan*, "Sealed–Type Screw Compressor", Publication No. 60119397, Jun. 26, 1985, Japanese Application No.58226167, Filed Nov. 30, 1983.

* cited by examiner

*Primary Examiner*—John J. Vrablik
(74) *Attorney, Agent, or Firm*—Barry R. Lipsitz; Douglas M. McAllister

(57) ABSTRACT

To provide a screw compressor comprising a compressor screw housing, two screw rotors with intermeshing screw bodies arranged in the compressor screw housing and with shaft sections arranged on both sides of the screw bodies, the screw rotors being mounted by means of the shaft sections in bearing housings arranged on both sides of the compressor screw housing, which prevents pressure losses, it is proposed that an intermediate portion of the respective shaft section adjoining an end of the respective screw body at the pressure side and extending as far as a bearing section be sealed off in the area of a closure wall of the compressor screw housing at the outlet side from an inside surface of an opening in the closure wall, which surrounds the intermediate portion.

17 Claims, 5 Drawing Sheets

SCREW COMPRESSOR HAVING A SHAFT SEAL NEAR A BEARING

This application is a continuation of international application number PCT/EP01/08597 filed on Jul. 25, 2001.

This application claims the benefit of German Patent Application No. 100 40 020.5 filed Aug. 16, 2000.

The present disclosure relates to the subject matter disclosed in international application PCT/EP01/08597 of Jul. 25, 2001, which is incorporated herein by reference in its entirety and for all purposes.

BACKGROUND OF THE INVENTION

The invention relates to a screw compressor comprising a compressor screw housing, two screw rotors with intermeshing screw bodies arranged in the compressor screw housing and with shaft sections arranged on both sides of the screw bodies, the screw rotors being mounted by means of the shaft sections in bearing housings arranged on both sides of the compressor screw housing.

Such screw compressors are known from the prior art, and, with these, there is the problem of providing at the pressure side as tight a closure as possible between the screw bodies and the compressor screw housing, so as to prevent losses of pressure.

SUMMARY OF THE INVENTION

This problem is solved, in accordance with the invention, in a screw compressor of the kind described at the outset, by an intermediate portion of the shaft section adjoining an end of the respective screw body at the pressure side and extending as far as a bearing section being sealed off in the area of a closure wall of the compressor screw housing at the outlet side from an inside surface of an opening in the closure wall, which surrounds the intermediate portion.

The advantage of the solution according to the invention is to be seen in the fact that owing to the seal between the intermediate portion and the inside surface of the opening, the gap existing between these cannot be penetrated by a parasitic flow of compressed working medium—which would travel from the volume area with compressed working medium to a volume area located opposite the outlet in close proximity to the closure wall of the compressor housing at the outlet side—and which therefore does not open a bypass causing a loss of compressed working medium which should exit from the outlet.

In principle, it is possible to maintain the seal in the gap between the intermediate portion and the inside surface of the opening by a film of oil.

However, a particularly expedient solution makes provision for a seal allowing radial movements of the intermediate portion relative to the inside surface to be arranged between the intermediate portion and the inside surface.

This solution has the advantage that in contrast to a sealing with oil, which requires a substantially uniform gap, which, in addition, should be kept as small as possible, the seal allows radial movement of the intermediate portion relative to the inside surface but still ensures sufficient tightness, so that the inventive solution can be employed in standard screw compressor solutions in which a radial movement of the intermediate portion relative to the inside surface is permissible, which occurs as a result of the screw bodies being subjected to forces acting on one side.

The seal could be provided in the direction of the axis of rotation in any partial area of the intermediate portion and the inside surface. A particularly expedient solution makes provision for the seal to be arranged essentially in close proximity to an edge of the opening that faces the respective screw body, preferably in an edge area of the opening that faces the screw body. The volume existing up to the seal in the gap between the intermediate portion and the inside surface is therefore kept as small as possible from the start.

The seal preferably lies in a third of the opening adjoining the edge of the opening that faces the respective screw body.

So far, no details have been given of the way in which the seal is configured. In a particularly advantageous solution, provision is made for the seal to comprise a sealing ring which offers the possibility of sealing between the intermediate portion and the inside surface in a simple way.

Such a sealing ring could, for example, be made of elastic material, so that radial movements of the intermediate portion relative to the inside surface would result in the sealing ring being pressed to different degrees.

A particularly advantageous solution makes provision for the seal to comprise a sealing ring seated in a groove and movable radially in relation to this groove. This makes it possible to bring about the radial movements of the intermediate portion relative to the inside surface by a relative displacement of the sealing ring with respect to the groove.

Here it is particularly expedient for the groove to be arranged in the intermediate portion.

A particularly expedient solution makes provision for the groove to be arranged in the intermediate portion near the end of the respective screw body at the pressure side.

It is expedient for the distance of the groove from an end face of the respective screw body to be at most five times, even better at most three times, a width of the groove in the direction of the axis of rotation.

A further expedient solution is configured such that the intermediate portion has adjacent to the end of the respective screw body at the pressure side an indentation located opposite the edge of the opening.

Such an indentation has the advantage that contact can then be avoided between the intermediate portion and the edge of the opening when the intermediate portion moves radially relative to the inside surface of the opening.

It is particularly expedient for the groove to be arranged so as to essentially follow the indentation.

It is preferable for there to be a spacing between the groove and an end face of the respective screw body, which corresponds at most to three times the extent of the indentation in the direction of the axis of rotation, with the indentation preferably having an extent in the direction of the axis of rotation which corresponds approximately to a width of the groove.

It is even better for the spacing of the groove from the end face to be of the order of magnitude of twice the extent of the indentation in the direction of the respective axis of rotation.

A ring-shaped bead is preferably provided between the indentation and the groove to ensure proper guidance of the sealing ring.

This ring-shaped bead expediently has an extent in the direction of the axis of rotation which at most corresponds approximately to the extent of the indentation in the direction of the axis of rotation.

A particularly preferred embodiment makes provision for several sealing rings to be arranged one after the other in the direction of the axis of rotation.

Further features and advantages of the invention are the subject matter of the following description and drawings of several embodiments.

DETAILED DESCRIPTION OF THE INVENTION

Figure 1:
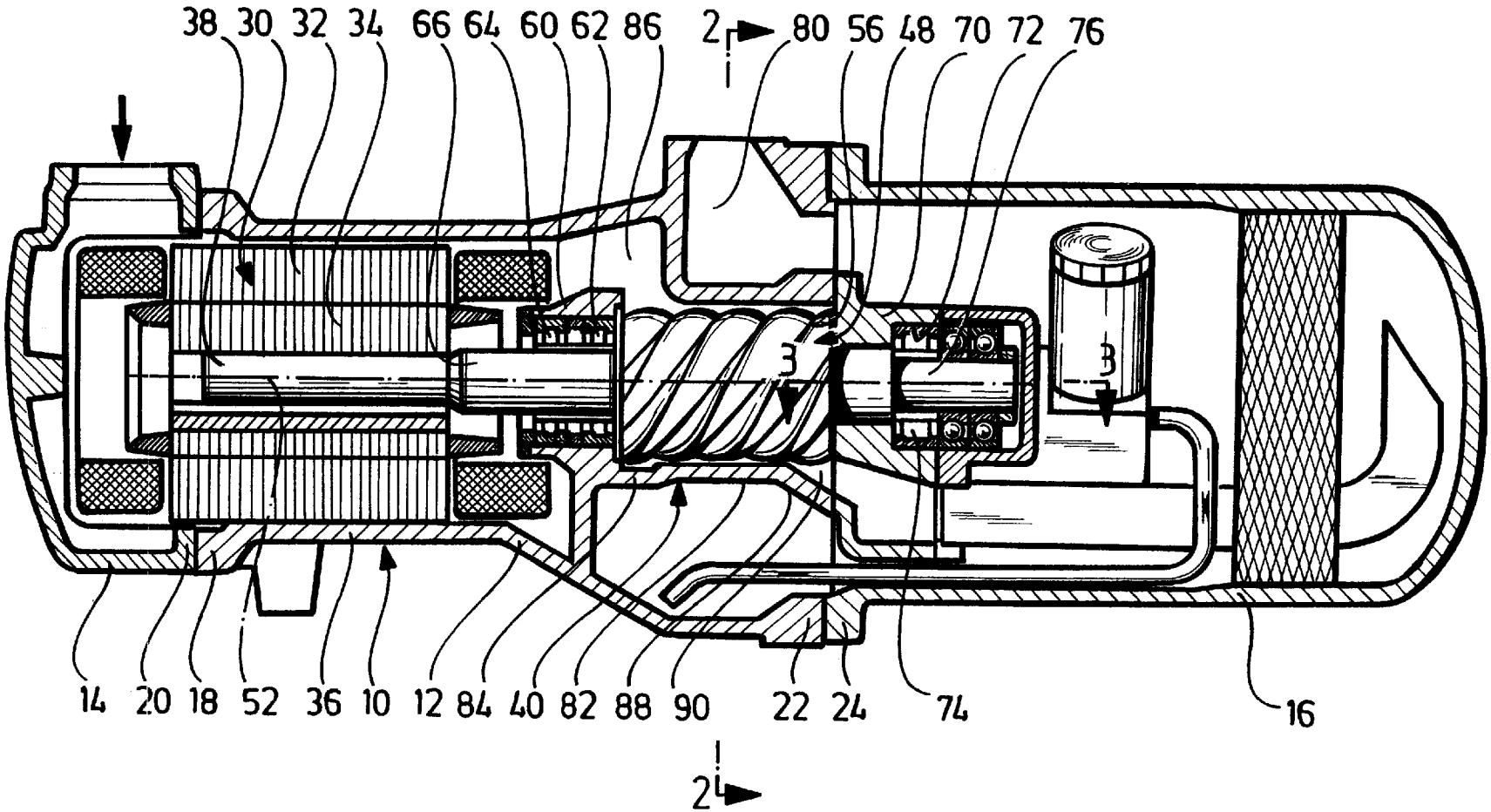
FIG. 1 shows a longitudinal section through a first embodiment of an inventive screw compressor taken along line 1—1 in FIG. 2.

An embodiment of an inventive screw compressor, shown in FIG. 1, comprises an outer housing generally designated 10, which is built up of a central section 12, an end section 14 on the motor side, and an end section 16 on the pressure side, which is arranged on the side of the central section 12 located opposite the end section 14 on the motor side.

The central section 12 and the end section 14 on the motor side are preferably connected to each other by two flanges 18 and 20, respectively, and the central section 12 to the end section 16 on the pressure side by flanges 22 and 24, respectively.

A drive motor generally designated 30 in the form of, for example, an electric motor comprising a stator 32 and a rotor 34 is provided in the outer housing 10. The stator 32 is preferably fixed securely in place in the outer housing 10, in particular, in a motor area 36 of the central section 12 facing the end section 14 on the motor side.

Figure 2:
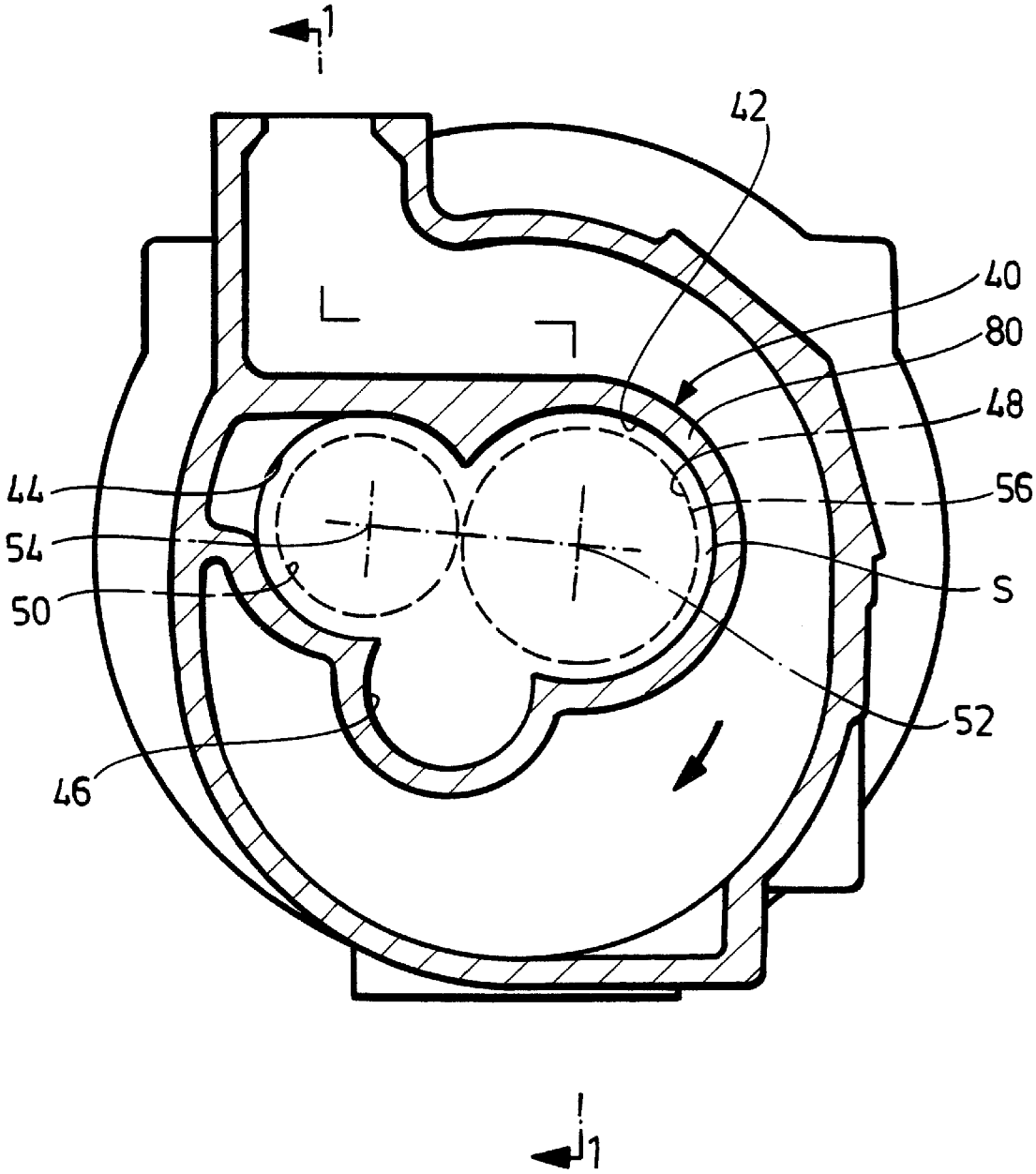
FIG. 2 shows a section taken along line 2—2 in FIG. 1.
Figure 3:
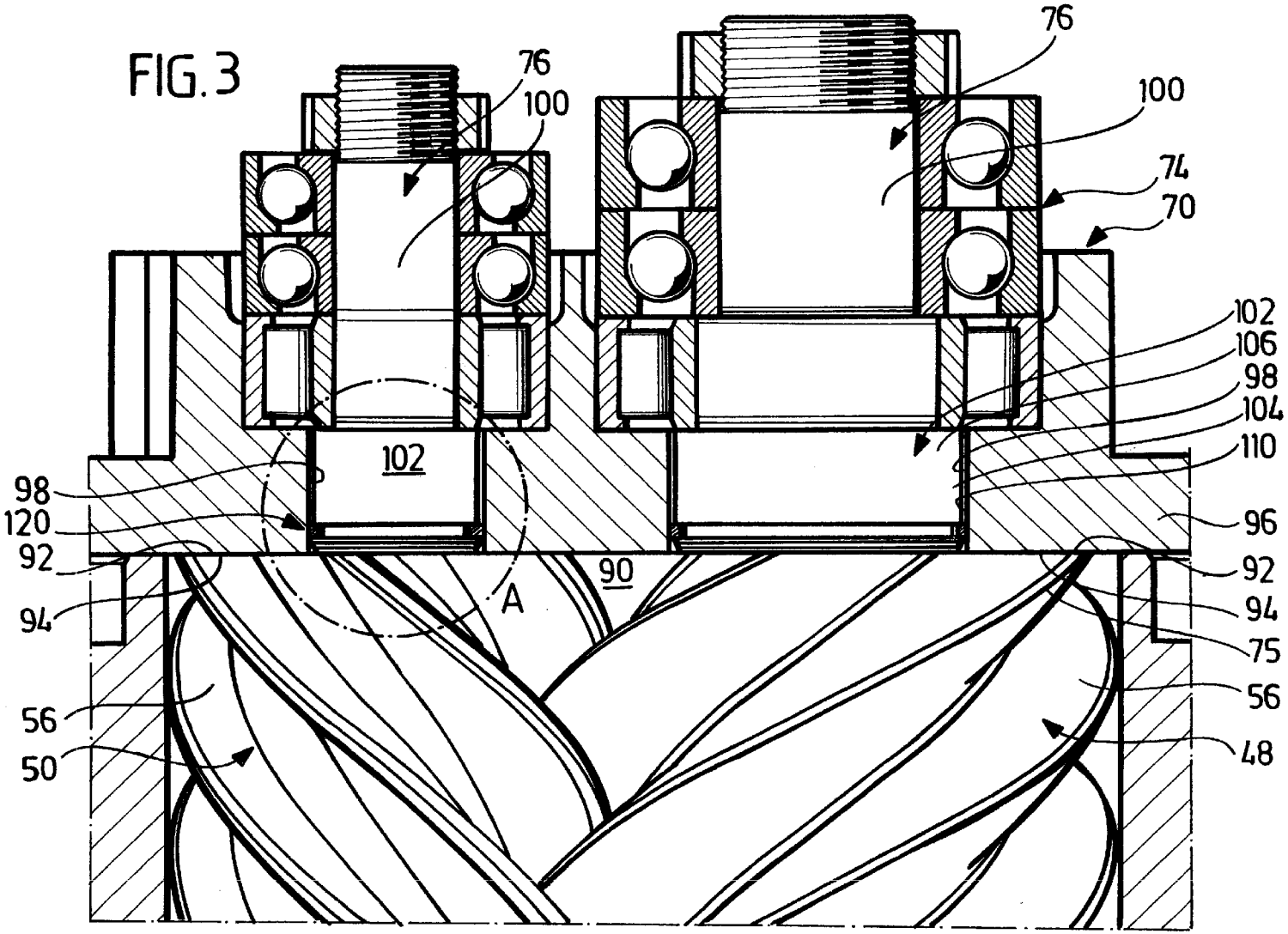
FIG. 3 shows a section taken along line 3—3 in FIG. 1.

A compressor screw housing generally designated 40 is provided within the central section 12 of the outer housing 10. As shown in FIG. 2, the compressor screw housing 40 has two rotor bores 42 and 44 which merge into one another as well as a slide bore 46 for, for example, a regulating slide not drawn in FIG. 1.

The rotor bores 42 and 44 serve to accommodate two screw rotors 48 and 50, respectively, which are common in a screw compressor. The screw rotors 48 and 50 are merely indicated by dashed lines in FIG. 2.

The two screw rotors 48 and 50 rotate about their respective axis of rotation 52 and 54, respectively, and are mounted for rotation about their axis of rotation 52 and 54, respectively, on both sides of their respective screw body 56.

To this end, a bearing housing 60 which has first bearing receiving means 62 for first rotary bearings 64 of the two screw rotors 48, 50 adjoins the compressor screw housing 40 on a side facing the drive motor 30. The screw rotors 48, 50 have shaft sections 66 which proceed from ends 65 of the screw bodies 56 at the suction side, and on which the rotary bearings 64 are seated. One of these shaft sections 66 is arranged coaxially with a drive shaft 38 of the drive motor 30 and is connected thereto.

On their side located opposite the bearing housing 60, the screw rotors 48, 50 are rotatably mounted in a second bearing housing 70 with second bearing receiving means 72 likewise by means of second rotary bearings 74. To this end, the screw rotors likewise have shaft sections 76 projecting from ends 75 of the screw bodies 56 at the pressure side.

The compressor screw housing 40 thus extends between the first bearing housing 60 and the second bearing housing 70 over the entire length of the screw bodies 56 in the direction of their rotor axes 52 and 54, respectively, and encloses the screw rotors 48 and 50 in the area of their screw bodies 56, so that there remains between the screw bodies 56 and the rotor bores 42 and 44 a sealing gap S which is constructed as small as possible for sealing.

All the areas of the compressor screw housing 40 in which a wall 80 of the compressor screw housing 40 extends relative to the screw bodies 56, thereby forming the gap S, form a compression section 82 of the compressor screw housing 40 which is adjoined on the inlet side, i.e., on a side facing the drive motor 30, by an inlet section 84 which forms an inlet 86 for working medium to be compressed, and on the outlet side, i.e., on a side located essentially diagonally opposite the inlet 86, by an outlet section 88 which forms an outlet 90, from which the compressed working medium exits.

Figure 4:
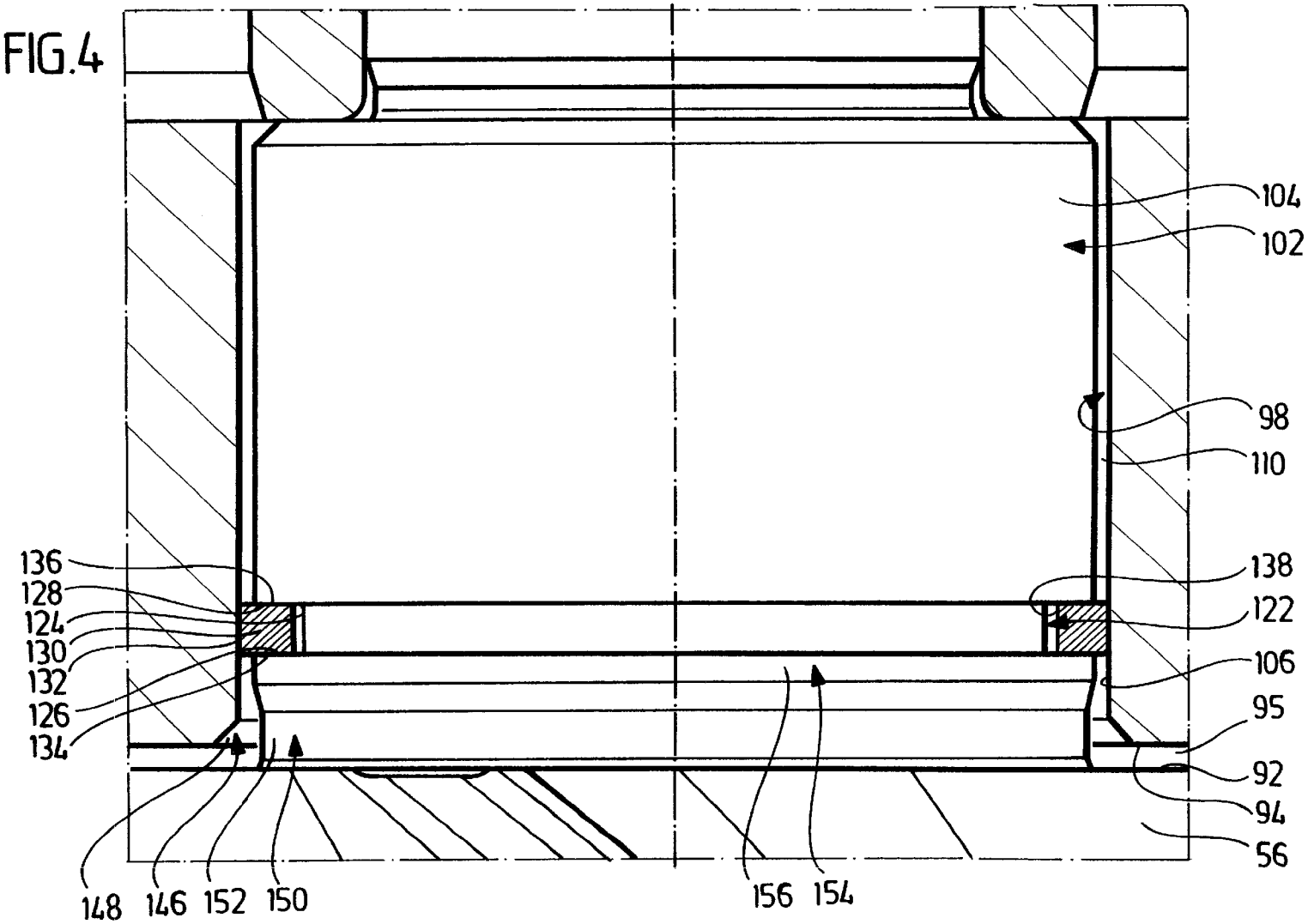
FIG. 4 is an enlarged illustration of area A in FIG. 3.

As shown in FIG. 4, in particular, the volume area with compressed working medium is sealed off on the pressure side from volume areas lying at a lower pressure by a small gap 95 between end faces 92 of the screw bodies 56 and a surface 94 of a closure wall 96 of the compressor screw housing 40.

The closure wall 96 is provided with openings 98 through which the shaft sections 76 extend, and the shaft sections 76 are mounted with bearing sections 100 in the second rotary bearings 74. The shaft sections 76 respectively extend with the bearing section 100 through the second rotary bearing 74 and between the bearing section 100 and the end 75 of the respective screw body 56 on the pressure side there extends an intermediate portion 102 of the respective shaft section 76, which is required for mounting the second rotary bearing 74 at a sufficiently large distance from the closure wall 96 and with sufficient stability in the second bearing housing 70.

The intermediate portion 102 essentially has a cylindrical circumferential surface 104 extending at a slight distance from an inside surface 106 of the respective opening 98 in the closure wall 96.

In accordance with the invention, in the area of the intermediate portion 102 and the opening 98 accommodating the latter a gap 110 arising between the inside surface 106 and the circumferential surface 104 is sealed in order to prevent in this gap 110 a parasitic flow of compressed working medium to volume areas under a lower pressure, in particular, to volume areas located opposite the outlet 90 and close to the closure wall 96.

For this reason, the inventive solution provides a seal generally designated 120 which is to prevent penetration of compressed working medium into the gap 110 and, in particular, advance thereof in the direction of the second rotary bearings 74.

As shown on an enlarged scale in FIG. 4, the intermediate portion 102 is provided close to the end face 92 with a circumferential groove 122 having a groove bottom 124 and groove walls 126 and 128 rising from the latter. Inserted in the groove 122 with play in radial direction in relation to the axis of rotation 54 is a sealing ring 130 which rests with an outer circumferential surface 132 against the inside surface 106 of the opening 98. With its two opposite end faces 134 and 136, the sealing ring 130 extends into the groove 122 between groove walls 126 and 128 of the groove 122 and is placed by the pressure in the area of the outlet 90 with its end face 136 against the groove wall 128. The sealing ring 130 does, however, have an inside surface 138 with a diameter which is larger than a diameter of the groove bottom 124 so that the sealing ring 130 is movable in radial direction in relation to the axis of rotation 54 relative to the groove 122.

Figure 5:
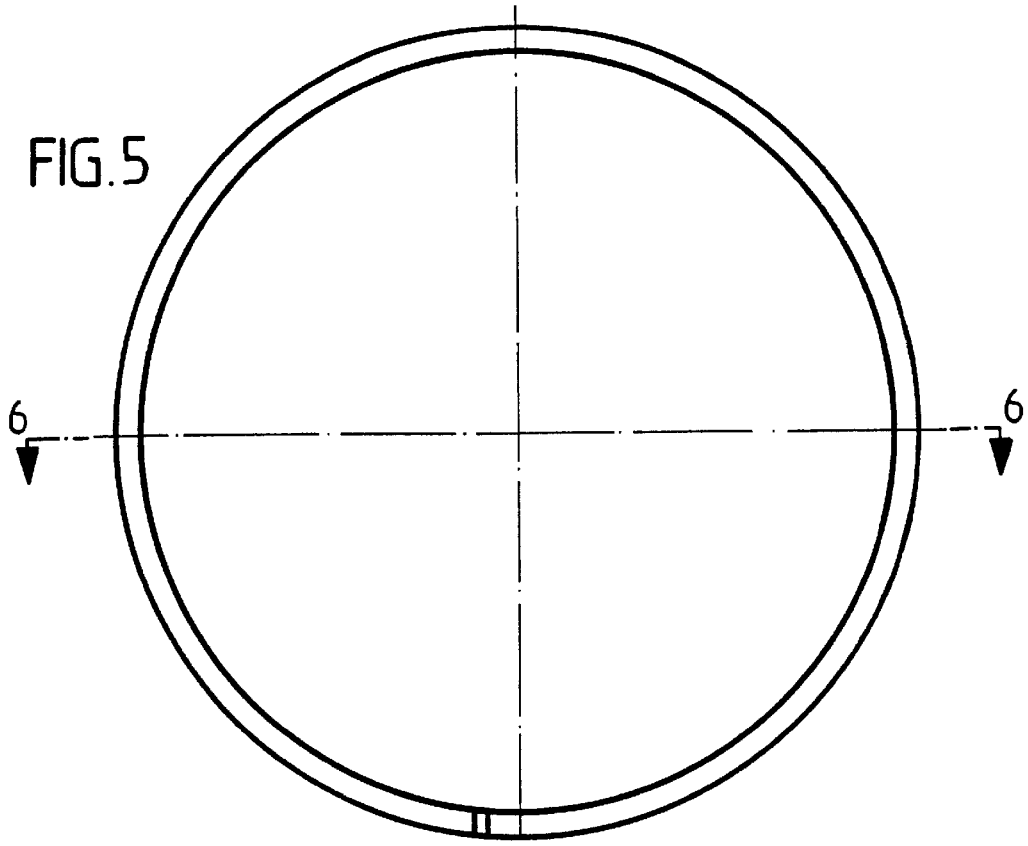
FIG. 5 is a front view of a sealing ring.
Figure 6:
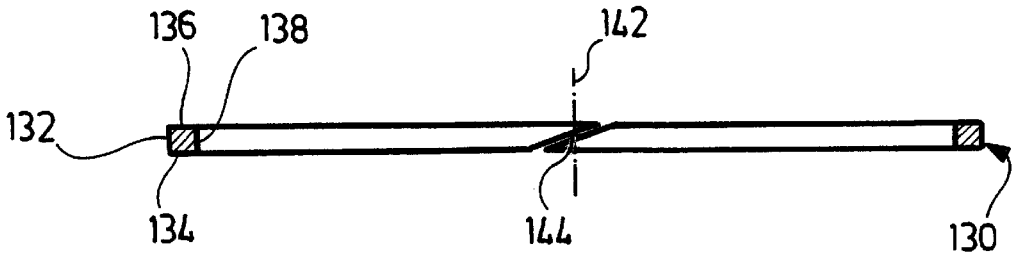
FIG. 6 shows a section taken along line 6—6 in FIG. 5.

As shown in FIGS. 5 and 6, the sealing ring 130 is preferably in the form of a ring of rectangular cross section, which forms the outer circumferential surface 132 on its outer side and the end faces 134 and 136 as surfaces parallel to each other, but offset in the direction of its axis 142, with the groove walls 126 and 128 preferably lying in planes extending perpendicularly to the axis 142 and also to the axis of rotation 54.

The sealing ring 130 is also provided with a slit 144 which allows radial expansion of the sealing ring 130 in relation to the axis 142.

The sealing ring 130 is preferably made of cast iron or Teflon filled with a material for increasing its strength, in particular, compressive strength.

In order to prevent the intermediate portion 102 from coming into contact with an edge 146 of the opening 98, in particular, in an area immediately adjoining the end face 92 of the respective screw body 56, owing to movements radially in relation to the axis of rotation 54, the edge 146 of the opening 98 is preferably provided with an inclined surface 148 which extends in the form of a conical surface in relation to the respective axis of rotation 54.

Immediately adjoining the end face 92, the intermediate portion 102 is provided with an indentation 150 extending in the shape of a ring with a base surface 152 which has a diameter smaller than that of the circumferential cylindrical surface 104.

In order to seal as close as possible to the surface 94 of the closure wall 96, the groove 122 lies so close to the indentation 150 that there remains between the indentation 150 and the groove 122 a ring-shaped bead 154 whose circumferential surface 156 has a diameter which corresponds approximately to that of the circumferential cylindrical surface 104 of the intermediate portion 102 and is preferably identical thereto.

The extent of the ring-shaped bead 154 in the direction of the axis of rotation 54 corresponds at most to the extent of the indentation 150 in the direction of the axis of rotation 54 and likewise at most to a width of the groove 122 in the direction of the axis of rotation 54.

The groove 122 is preferably spaced at a distance from the end face 92 of the screw body 56 which corresponds at most to five times the width of the groove 122 in the direction of the axis of rotation 54.

We claim:

1. Screw compressor comprising a compressor screw housing, a closure wall at an outlet side of said housing, two screw rotors with intermeshing screw bodies arranged in said compressor screw housing, shaft sections arranged on both sides of said screw bodies, said screw rotors being mounted by means of said shaft sections in bearing housings arranged on both sides of said compressor screw housing, a seal preventing parasitic flow of compressed working medium between (i) an intermediate portion of the respective shaft section adjoining an end of the respective screw body at a pressure side and extending as far as a bearing section and (ii) an inside surface of an opening provided in said closure wall and surrounding said intermediate portion, said seal being arranged essentially in close proximity to an edge of the corresponding opening facing the respective screw body, within a third of an extension in a direction of an axis of rotation of the opening adjoining said edge facing the respective screw body, and an indentation provided in said intermediate portion adjacent to the end of the respective screw body at the pressure side and located opposite an edge of said opening, said seal comprising a sealing ring seated in a groove and movable radially in relation to said groove.

2. Screw compressor in accordance with claim 1, wherein said groove is arranged in said intermediate portion.

3. Screw compressor in accordance with claim 1, wherein said groove is arranged in said intermediate portion near the end of the respective screw body at the pressure side.

4. Screw compressor in accordance with claim 3, wherein said groove is spaced at a distance from the end face of the respective screw body which corresponds at most to approximately three times the width of said groove in the direction of the axis of rotation.

5. Screw compressor in accordance with claim 1, wherein said groove is spaced at a distance from an end face of the respective screw body which corresponds at most to approximately three times the extent of said indentation in the direction of the respective axis of rotation.

6. Screw compressor in accordance with claim 1, wherein said groove is spaced at a distance from the end face of the respective screw body which is of the order of magnitude of twice the extent of said indentation in the direction of the axis of rotation.

7. Screw compressor in accordance with claim 1, wherein a ring-shaped bead is provided between said groove and said indentation.

8. Screw compressor in accordance with claim 7, wherein said ring-shaped bead has an extent, in the direction of the axis of rotation, which corresponds at most to the extent of said indentation in the direction of the axis of rotation.

9. Screw compressor comprising:

a compressor screw housing, a closure wall at an outlet side of said housing, two screw rotors with intermeshing screw bodies arranged in said compressor screw housing, shaft sections arranged on both sides of said screw bodies, said screw rotors being mounted by means of said shaft sections in bearing housings arranged on both sides of said compressor screw housing, a seal between (i) an intermediate portion of the respective shaft section adjoining an end of the respective screw body at a pressure side and extending as far as a bearing section and (ii) an inside surface of an opening provided in said closure wall and surrounding said intermediate portion, said seal comprising a sealing ring seated in a groove arranged in said intermediate portion and movable radially in relation to said groove, said groove being spaced at a distance from the end face of the respective screw body which corresponds at most to approximately three times the width of said groove in the direction of an axis of rotation, and an indentation provided in said intermediate portion adjacent to the end of the respective screw body at the pressure side and located opposite an edge of said opening, said groove being arranged on a side of said indentation that is located opposite said screw body.

10. Screw compressor in accordance with claim 9, wherein the seal is arranged between said intermediate portion and said inside surface, said seal allowing radial movements of said intermediate portion relative to said inside surface.

11. Screw compressor in accordance with claim 10, wherein said seal is arranged essentially in close proximity to an edge of the corresponding opening facing the respective screw body.

12. Screw compressor in accordance with claim 9, wherein said seal is arranged after a surface of said closure wall.

13. Screw compressor in accordance with claim 9, wherein said groove is arranged in said intermediate portion near the end of the respective screw body at the pressure side.

14. Screw compressor in accordance with claim 9, wherein said groove is spaced at a distance from an end face of the respective screw body which corresponds at approximately to three times the extent of said indentation in the direction of the respective axis of rotation.

15. Screw compressor in accordance with claim 9, wherein said groove is spaced at a distance from the end face of the respective screw body which is of the order of magnitude of twice the extent of said indentation in the direction of the axis of rotation.

16. Screw compressor in accordance with claim 9, wherein a ring-shaped bead is provided between said groove and said indentation.

17. Screw compressor in accordance with claim 16, wherein said ring-shaped bead has an extent, in the direction of the axis of rotation, which corresponds at most to the extent of said indentation in the direction of the axis of rotation.

* * * * *